US008061416B2

(12) United States Patent
Geskes et al.

(10) Patent No.: US 8,061,416 B2
(45) Date of Patent: Nov. 22, 2011

(54) HEAT EXCHANGER AND METHOD FOR THE PRODUCTION THEREOF

(75) Inventors: Peter Geskes, Stuttgart (DE); Jens Richter, Groβbottwar (DE)

(73) Assignee: Behr GmbH & Co. KG, Stuttgart (DE)

( * ) Notice: Subject to any disclaimer, the term of this patent is extended or adjusted under 35 U.S.C. 154(b) by 1486 days.

(21) Appl. No.: 10/566,053

(22) PCT Filed: Jul. 29, 2004

(86) PCT No.: PCT/EP2004/008542

§ 371 (c)(1),
(2), (4) Date: Aug. 28, 2006

(87) PCT Pub. No.: WO2005/012820

PCT Pub. Date: Feb. 10, 2005

(65) Prior Publication Data

US 2007/0107890 A1 May 17, 2007

(30) Foreign Application Priority Data

Aug. 1, 2003 (DE) ..... 103 36 033

(51) Int. Cl.
*F28F 3/08* (2006.01)

(52) U.S. Cl. ..... 165/167; 165/DIG. 372

(58) Field of Classification Search ..... 165/166, 165/167

See application file for complete search history.

(56) References Cited

U.S. PATENT DOCUMENTS

| | | | | |
|---|---|---|---|---|
| 3,661,203 | A * | 5/1972 | Mesher | 165/167 |
| 3,731,737 | A * | 5/1973 | Jenssen | 165/167 |
| 3,817,324 | A * | 6/1974 | Andersson | 165/167 |
| 3,862,661 | A * | 1/1975 | Kovalenko et al. | 165/167 |
| 4,301,864 | A * | 11/1981 | Kivikas et al. | 165/167 |
| 4,489,778 | A * | 12/1984 | Skoog | 165/166 |
| 4,630,674 | A * | 12/1986 | Skoog | 165/147 |
| 4,781,248 | A * | 11/1988 | Pfeiffer | 165/167 |
| 5,462,113 | A * | 10/1995 | Wand | 165/167 |
| 5,531,269 | A * | 7/1996 | Dahlgren | 165/167 |
| 5,544,703 | A * | 8/1996 | Joel et al. | 165/167 |
| 5,988,269 | A * | 11/1999 | Karlsson et al. | 165/167 |
| 6,016,865 | A * | 1/2000 | Blomgren | 165/148 |
| 6,164,372 | A * | 12/2000 | Persson | 165/167 |
| 6,286,589 | B1 | 9/2001 | Uehara | |
| 6,389,696 | B1 * | 5/2002 | Heil et al. | 29/890.039 |
| 6,394,178 | B1 | 5/2002 | Yoshida et al. | |

(Continued)

FOREIGN PATENT DOCUMENTS

DE 199 59 780 A1 6/2002

(Continued)

*Primary Examiner* — Allen Flanigan

(74) *Attorney, Agent, or Firm* — Muncy, Geissler, Olds & Lowe, PLLC

(57) ABSTRACT

A heat exchanger which is especially used as an oil cooler in the motor vehicle industry includes interconnected plates. Outwardly closed cavities are embodied between the plates and are alternately supplied with a first or second medium by at least one supply line and one discharge line, and a corresponding medium flows through them. The plates are profiled in such a way that contact points are created between the respective profiles of the plate, and the plates are interconnected in the region of the contact points. The plates are designed such that the current from the first or second medium forming between the plates, from the corresponding supply line to the corresponding discharge line, does not follow a linear path.

27 Claims, 10 Drawing Sheets

U.S. PATENT DOCUMENTS

| | | | | |
|---|---|---|---|---|
| 6,702,005 | B1 * | 3/2004 | Blomgren | 165/166 |
| 6,823,934 | B2 * | 11/2004 | Andersson | 165/167 |
| 7,040,387 | B2 * | 5/2006 | Leuthner et al. | 165/166 |

FOREIGN PATENT DOCUMENTS

| | | | |
|---|---|---|---|
| EP | 1 070 928 | A1 | 1/2001 |
| FR | 2 821 926 | A1 | 9/2002 |
| GB | 1 468 514 | | 3/1977 |
| JP | 46-003389 | | 5/1971 |
| JP | 56-030634 | | 10/1981 |
| JP | 04-049776 | U | 4/1992 |
| JP | 8-094276 | | 4/1996 |
| JP | 08-159685 | A | 6/1996 |
| JP | 9-072685 | A | 3/1997 |
| JP | 11-248392 | A | 9/1999 |
| JP | 2000-266480 | A | 9/2000 |
| JP | 2000-346583 | A | 12/2000 |
| JP | 2001056192 | A * | 2/2001 |
| JP | 2002-107084 | A | 4/2002 |
| JP | 2002-257488 | A | 9/2002 |
| WO | WO 85/02670 | A1 | 6/1985 |
| WO | WO 86/05866 | A1 | 10/1986 |

* cited by examiner

HEAT EXCHANGER AND METHOD FOR THE PRODUCTION THEREOF

FIELD OF THE INVENTION

The present invention relates to a heat exchanger, such as is used, particularly in vehicles, as an oil cooler, and to a method for the production thereof.

BACKGROUND OF THE INVENTION

Plate heat exchangers, as they are referred to, which are formed from a stack of plates lying next to one another are known. Between the plates, cavities are formed, through which a first and a second medium flow alternately.

As well as use as a cooler, in which case, for example, the first medium is cooling water and the second medium is the working medium to be cooled, the engine oil where an oil cooler/internal combustion engine is concerned, use as an evaporator of a cooling apparatus, such as a vehicle air conditioning system, may also be envisaged, in which case one of the two media is the coolant and the other is the refrigerant.

In this context, it is known that the plates are profiled so that contact points occur between the plates. The plates are fastened to one another in the region of the contact points. Furthermore, on the outside, the plates bear sealingly one against the other, so that the cooling medium or the working medium flows solely through the cavity. The first and the second medium are thus in each case supplied through a corresponding inflow line and discharged via an outflow line. Inflow lines and outflow lines thus in each case serve as collecting lines in which the fluid stream is respectively supplied to and discharged from all the corresponding cavities.

Conventionally, in plate heat exchangers, turbulence-increasing fittings for improving the heat transmission and for surface enlargement are introduced into the fluid ducts and are connected firmly to the heat-exchanging plate. As a result, not only the thermodynamic property of the duct, but also the strength property of the cooler are greatly improved.

One disadvantage of such turbulence plates is that chip formation easily occurs during the production of the passage orifices and may lead to contamination of the medium flowing through. Furthermore, dirt is easily deposited in the region of the turbulence plates. The throughflow of the cavity may thereby be impeded in an undesirable way. Moreover, they constitute an additional component to be produced which makes the heat exchanger more expensive on account of increased production costs and material costs.

SUMMARY OF THE INVENTION

The object of the invention is, therefore, to provide a heat exchanger which does not have the disadvantages of known heat exchangers.

This object is achieved, according to the invention, by means of a plate heat exchanger which can be produced in a particularly beneficial way by means of a method according to the invention.

A heat exchanger, such as is used particularly as an oil cooler in the motor vehicle sector, is formed from interconnected plates. Cavities closed off outwardly are formed between the plates. The cavities are alternately supplied with a first and a second medium in each case via at least one inflow and outflow line and the corresponding medium also flows through them. In this case, the plates are profiled in such a way that contact points occur between the respective profiles of the plates. The plates are connected to one another in the region of these contact points. At the same time, the plates are configured such that the flow, formed between the plates, of the first or the second medium from the corresponding inflow line to the corresponding outflow line does not run rectilinearly.

The advantage of this measure is that the medium flowing through is in part multiply deflected on its flow path. The distribution of the fluids over the plate width is thereby improved. Under certain circumstances, even turbulent flows arise as a function of the flow behavior (viscosity) of the medium flowing through. The repeatedly occurring changes in direction of the fluid in the duct and the vortices which, under certain circumstances, are formed in the region of the opening wavy duct repeatedly break up the boundary layer formed. This leads to improved heat transmission.

According to a preferred refinement of the invention, the plates have a recurring wavy profile which then runs at least in a direction transverse with respect to the throughflow direction which is the straight connection from the inlet point of the medium to the outlet point. The wavy profile runs around this direction in a zigzag-shaped manner. Such a wavy profile forms in a simple way flow guide regions which are suitable for guiding the flow of the medium flowing through the corresponding cavity. The flow is thereby advantageously multiply deflected in its run, specifically, in particular, not only in the plate plane, but also out of the plate plane. Under certain circumstances, the flow velocity varies in regions in which the distance between the plates is made different. What is advantageously achieved at the same time is that, overall, the medium is distributed over the entire surface of the plates and therefore an as far as possible optimized utilization of the entire heat exchange surface takes place.

According to a developing refinement, the wavy profile has legs running rectilinearly between flow regions, the run of the wavy profile being characterized by the leg length of the legs, by the leg angle defined between the legs and by the profile depth of the wavy profile. The profile of a wavy profile is fixed in its cross section by the run in the region of the legs and in the region of curvature, while preferred refinements may provide deviation of the cross-sectional form in these regions.

The wavy profile running in a zigzag-shaped manner is in this case characterized particularly by the leg length, the leg angle between adjacent legs and the profile depth. According to preferred refinements of the invention, the leg length is in the range of 8 to 15 mm, preferably in the range of 9 to 12 mm. Typical values of the profile depth, which is calculated, for example, from the distance between a wave crest and the plate center plane, are in the range of 0.3 to 1.5 mm. For many applications, a profile depth of between 0.5 and 1 mm may be advantageous, while values of approximately 0.75 mm may be preferred. The profile depth may be also between 0.3 mm and 2 mm, in the case of liquid media preferably between 0.5 mm and 1 mm and, in particular, between 0.7 mm and 0.8 mm, and, in the case of gaseous media, preferably in the range between 0.6 mm and 2 mm and, in particular, around 1.5 mm. The leg angle between two legs of the wavy profile is preferably between 45° and 135°. Particularly values around 90° constitute a good compromise with regard to the distribution of fluid, the throughflow velocity and the throughflow capacity of the heat exchanger.

The leg length and the leg angle influence, on the one hand, the flow guide function of the wavy profile, but, on the other hand, also the arrangement of contact points of adjacent plates against one another, which are required for the stability of the heat exchanger. The inherent rigidity of the plates with respect to compressive action by the media cannot be ensured without mutual support, when the selected material thickness of the plate is low, as is desirable in many applications for reasons of weight saving and heat exchange.

Thus, in a preferred refinement, a connection of the plates in the region of the contact points by brazing takes place, for which purpose the plates are coated at least on one side with a soldering aid, such as a solder. The selection of leg length and leg angle takes place preferably as a function of the medium flowing through and its viscosity. The leg length and leg angle have a great influence on the flow velocities occurring and on the heat exchange associated therewith, so that these can be adapted to the respective intended use. The abovementioned values in this case relate particularly to the use of heat exchangers as oil coolers in vehicles where heat exchange takes place between engine oil and cooling water. Furthermore, they also depend, of course, on the dimensioning of the plates and of the interspace occurring due to the distance between the plates.

The configuration of the wavy profile is fixed essentially by the form of the cross section perpendicularly to the outer edge of the profile in this region and by the profile sequence, fixed by the division, in the run transverse with respect to the direction of extent of a wavy profile over the plate. Preferred refinements provide a constant division, that is to say a fixed distance between any two wavy profiles adjacent to one another. The configuration of the wavy profile is advantageous particularly when it has a flat region on the outside of the wave back. The flat region in this case has, in particular, a width of 0.1 to 0.4 mm. The flat region makes it possible for plates adjacent to one another to bear effectively one against the other over a large area and consequently allows easy and stable production of the support or connection, such as by brazing, of adjacent plates to one another.

The material of the plates is preferably aluminum. The advantage of this material is that it has low density and at the same time makes it possible to produce the wavy profile, for example, by embossing in a simple way. To make the connection between two adjacent plates, at least one side may be coated over its entire surface with soldering aid, such as brazing alloy, in the region of the contact points and in the region of the edges. Depending on the selection of the soldering aid and of the layer thickness of the coating of the soldering aid, coating on both sides with soldering aid may also be provided. The coating with soldering aid is to serve, particularly in the region of the edges and of the inflow and outflow lines in the block, for the reliable production of a fluidtight connection of two plates to one another in a joining operation by means of a joining tool (brazing furnace), without the use of further aids or auxiliaries.

In a developing refinement, there may be provision for the plates to have bores which serve in the region of the heat exchanger as inflow lines and outflow lines and the bore axis of which runs perpendicularly with respect to the plate plane. In this case, the bores are introduced, in particular, in a region which is raised with respect to the basic plane of the plates. The raised region is in this case preferably raised such that a leaktight connection between the raised region and the following further plate is obtained in every second plate interspace, so that a fluidic connection between the bores and the plate interspace occurs only in the case of every second plate interspace. By virtue of this measure, without lines being used, a fluid supply and fluid discharge to and from the plate interspaces are made possible, so that either the cooling medium or the working medium flows through these alternately.

In this case, the fluidtight bearing contacts between a raised region and an adjacent plate may be achieved not only by positive connection, but also by another connecting technique, such as brazing. For this purpose, the raised region has, in particular, a preferably large-area bearing portion which is in bearing contact with a preferably large-area bearing edge of the adjacent plate with which a fluidtight connection is obtained.

The raised region and the bores in the raised region may in this case not only have a circular cross section, but, instead, oval or long hole-like configurations are also possible and advantageous. In this case, the longer of the two axes of the long hole-like configuration is preferably to be arranged transversely with respect to the main flow direction of the fluid. This measure, too, serves for improving the heat exchange between the two media, since then, with the overall extent of the plates being the same, a larger heat exchange surface remains.

Furthermore, it is possible that distributor ducts, which are preferably likewise designed as a wavy profile, are provided in the region of the inflow lines and the bores assigned to the inflow lines. It conforms to particularly preferred developing refinements of the invention when the wavy profile of the distributor ducts differs from the remaining wavy profiles in terms of the characteristic parameters of the wavy profile. The wavy profile of the distributor ducts in this case has, in particular, a leg angle which is smaller than 450 and, in particular, is in the range of approximately 50 and approximately 250. Both an abrupt and a continuous transition in the profile configuration between the distributor profile and the wavy profile may be formed in the remaining plate regions. The distributor ducts in this case assume the task of an as far as possible uniform distribution of the fluid stream over the entire width of the plate. This improves the efficiency of the heat exchanger, since, in this case, a larger heat exchange surface is actually also used for exchange. Moreover, to improve the distribution of the medium over the entire surface of the heat exchanger, flow-around ducts may surround the raised regions. The flow-around ducts are in this case preferably formed by a portion which is free of wavy profile and which, in particular, is led around the raised region in a ring-like manner. A portion of reduced flow resistance is thus formed, into which a plurality of wavy profiles issue, so that as a result of this, too, a distribution function for the medium is fulfilled.

It conforms to an embodiment of a heat exchanger according to the invention which is particularly simple and cost-effective to produce when the latter is produced from a sequence of plates. In this case, the plates may have on their two sides profiles which are different from one another in terms of their wavy profiles. A heat exchanger may be formed, in particular, from a stack of such plates configured identically to one another. This is because, in this case, it is possible, in particular, for plates adjacent to one another to be rotated through 180 degrees with respect to one another, the axis of rotation extending perpendicularly with respect to the plate plane. This type of stack of plates is advantageous particularly when the bores assigned to the inflow lines are formed from raised points and these are to be assigned alternately to two different line routes. In this case, the elevations in the region of the inflow lines may be designed, in particular, as an essentially frustoconical dome. Dome-shaped elevations which have an elliptic cross section are an alternative to this.

The plates may in this case be configured identically or correspondingly or similarly to one another or differently from one another. Plates identical to one another have identical properties in terms of the characteristic properties of the wavy profile and the configuration of the wavy profile. Plates corresponding to one another are identical to one another in construction, but it is possible, for example, for the plates to have leg angles different from one another. Plates corresponding to one another preferably have configurations of the wavy profile which are different from one another and/or values, different from one another, of characterizing parameters, but correspond to one another in terms of the formation of the edge and the design of the front and the rear side of the plates. The alternate use of, for example, two plates corresponding to one another, which differ from one another only in different leg angles in the characteristic parameters, has the advantage that the position and relative situation of contact points of the plates against one another in the profiled region can be optimized in a simple way in terms of the required rigidity and the required throughflow.

The connection between the plates is made, in particular, by brazing. In order to achieve a good sealing action and at the same time a stable construction of the heat exchanger in the region of the edge of the plates, there may be provision for the plates to have a bent edge, the height of which is selected such that at least two plates adjacent to one another bear one against the other and mutually overlap in this edge region. The number of plates mutually overlapping in the edge region may in this case be up to five. The larger the number of mutually overlapping plates is, the more rigid is the wall formed thereby and outwardly closing off the heat exchanger. This is at the same time conducive to the production of a permanently stable resistant fluidtight outward closure of the plates. In this case, according to preferred developing refinements, the wavy profile extends into the edge and, in particular, over its entire width. At the same time, it is necessary to ensure, in the configuration of the wavy profile, that the plates nevertheless remain stackable, this being achieved in that the run of the wavy profile in the edge region is coordinated with the mounting position of two adjacent plates with respect to one another.

The wavy profile extends into the edge when the wavy profile ends in the root region of the bend, so that the profile extends with its profile depth into the edge. Particularly for reasons of production technology, it may be advantageous if the root of the edge lies in a region free of wavy profile, since the bending of the edge can then take place in a region not reinforced by a profile. Then, according to preferred refinements, the channel formed between the edge and the wavy profile region is as narrow as possible. It is selected, in particular, to be so narrow that, during brazing, a solder flux occurs which blocks this channel completely or at least to an extent such that only a negligible quantity of medium flows through the channel. The channel must be configured such that it does not serve as a bypass duct for the medium and a substantial fraction of medium does not flow through the channel instead of in the region of the wavy profile.

To improve the outward stability of the heat exchanger and to simplify the connection of the external inflow lines and external outflow lines for coolant and working medium, there may be provision for a closing plate profileless on the outside to be arranged on at least one of the end faces of the heat exchanger. The closing plate profileless on the outside in this case has, in particular, flanges as connection points. The closing plates may, in particular, also have a greater material thickness than the other plates and thus constitute an, in particular, reinforcing stabilizing element which forms a housing part outwardly closing off the end faces. The lateral housing walls which outwardly close off the heat exchanger are formed via the edge which delimits the plates and which overlaps with the edge of adjacent plates. The edges are in this case connected to one another in a fluidtight manner, which may take place, in particular, by brazing.

One possibility for characterizing the throughflow capacity of a stack of plates is to determine the hydraulic diameter between two adjacent plates along the main flow direction of the medium. The hydraulic diameter in this case constitutes a ratio between the throughflow-capable duct cross section and the heat exchange surface. The hydraulic diameter hD is in this case defined as the quadruple of the ratio of surface ratio Fv to surface density Fd. The surface ratio Fv is determined as the ratio of the free duct cross section fK to the overall end face S of the duct between two adjacent plates, and the surface density Fd is determined from the ratio of heat-exchanging surface wF to block volume V. Thus:

$$hD = \frac{4\frac{fK}{S}}{\frac{wF}{V}}$$

In this case, according to a preferred refinement of the invention, the hydraulic diameter should remain as far as possible constant over the entire main flow direction of the medium. This achieves an, under certain circumstances, improved and, if appropriate, uniform throughflow capacity of the plate interspace which forms the duct.

According to, a preferred refinement of the invention, and particularly when the heat exchanger is used as an oil cooler, the hydraulic diameter is between 1.1 mm and 2 mm. Preferred values for the hydraulic diameter are around 1.4 mm. In this case, the deviation of the hydraulic diameter should preferably fluctuate by no more than 10%, in particular by less than 5%, over the period of the profiling of a pair of plates. The selection of the hydraulic diameter is, of course, also dependent on the media flowing in the interspaces between the plates. Said values apply to an oil cooler in which, on the one hand, water and, on the other hand, an oil flow through the heat exchanger.

According to a preferred version, the contact points between two plates of the heat exchanger which are adjacent to one another are distributed uniformly over the plate surface. Preferably, the contact points between two plates adjacent to one another have a surface density of 4 to 7 per $cm^2$, particularly preferably of 5 to 6 per $cm^2$. In such a configuration, a sufficient strength of the heat exchanger is possible, without an excessive rise in the pressure loss.

Heat exchangers according to the invention may serve, on the one hand, as oil coolers, but also as evaporators or condensers. In this case, the refrigerating circuit of such a device may not only serve for the air conditioning of a (vehicle) interior, but also for the cooling of heat sources, such as electrical consumers, energy stores and voltage sources, or of charge air of a turbocharger. The heat exchanger is a condenser when heat exchange takes place, for example, as a result of the condensation of the refrigerant of an air conditioning system in a coolant-loaded compact heat exchanger and the coolant discharges the heat in a heat exchanger to air as a further medium. The evaporation or condensation of another medium in a heat exchanger according to the invention may also take place, for example, in applications in fuel cell systems.

In all these applications as a condenser or evaporator, it is desirable to use a heavy-duty compact heat exchanger in which a coolant, as a second medium, discharges or absorbs the heat. In this case, on account of very high internal purity requirements on the refrigerant side, it is not possible to use stamped turbulence inserts which introduce aluminum particles into the refrigerant circuit. As well as these purity requirements, it is likewise necessary to have at the inlet an optimum distribution of the fluid which subsequently evaporates or condenses in the heat exchanger. Ideally, the fluid, which is present at the inlet predominantly in liquid form in the case of evaporation and in vaporous form in the case of condensation, is distributed over the entire disk width. A particular feature of evaporation and condensation is the low temperature difference often present between the two fluids. If the transverse distribution of the liquid fluid to be evaporated or of the vaporous fluid to be condensed is not optimal, high power losses can quickly occur. Heat exchangers according to the invention afford solutions to these problems.

In a method according to the invention for the production of a heat exchanger, in particular of a heat exchanger according to the invention, the wavy profile is produced by the embossing of the plates, and subsequently a correspondingly oriented stacking of the plates and thereafter connection by brazing take place. According to a preferred refinement, the stacking of the plates one on the other takes place such that in each case two plates adjacent to one another are arranged so as to be rotated through 180 degrees. The connection of the plates by brazing in this case takes place, in particular, such that the plates are sealingly connected to one another at their edge and, in particular, at the same time a connection of adjacent plates at the contact points of profiles takes place. In a particularly advantageous refinement, a stable and distortion-resistant element is thereby produced.

BRIEF DESCRIPTION OF THE DRAWINGS

Moreover, the invention is explained in more detail below with reference to the exemplary embodiment illustrated in the drawing in which.

DETAILED DESCRIPTION

Figure 1A:
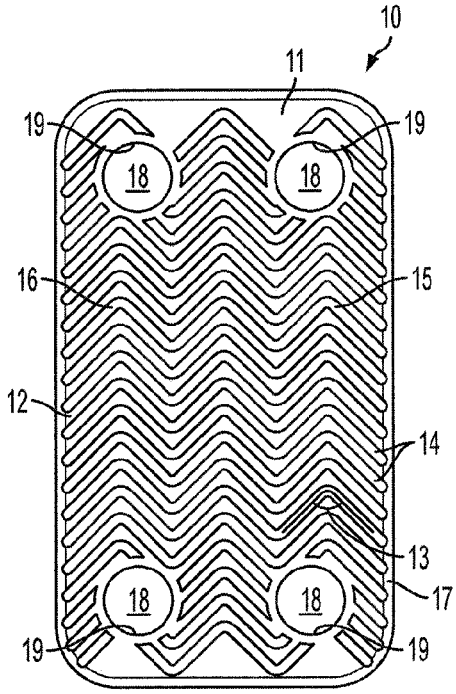
FIG. 1*a*, 1*b* show the front side and rear side of a plate according to the invention.
Figure 1B:
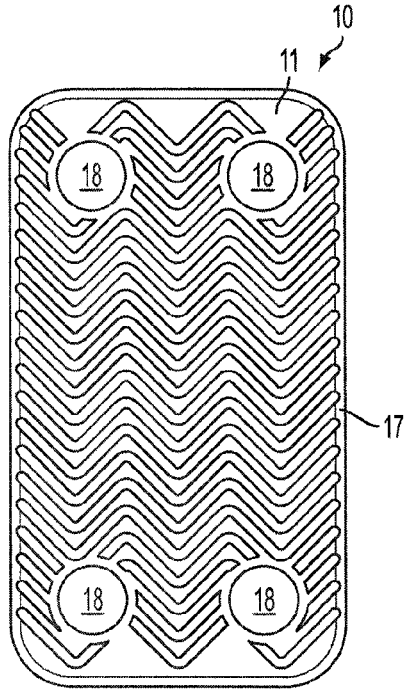
Figure 2:
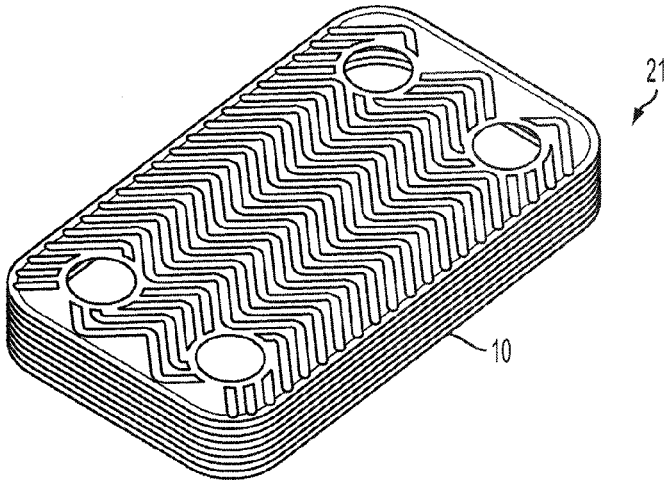
FIG. 2 shows a view of a stack of such plates.

FIGS. 1*a* and 1*b* show an illustration of a front side and of a rear side of a plate according to the invention respectively, while FIG. 2 shows an illustration of a corresponding stack formed from plates according to FIGS. 1*a* and 1*b*.

A plate 10 has a basic body 11 which is provided on its front side and rear side in each case with a wavy profile 12 which has been introduced into the basic body 11 by embossing. In the embodiment illustrated in FIGS. 1*a* and 1*b*, the wavy profile 12 of the rear side according to FIG. 1*b* corresponds to the negative profile of the front side according to the illustration in FIG. 1*a*. In this case, the wavy profile 12 is formed from a plurality of legs 10 which are at a leg angle 13 to one another and which in each case have a fixed leg length 15 and connect the regions of curvature 16 to one another. The wavy profile extends transversely over the plate 10. A multiplicity of wavy profiles 12 are formed in succession over the length of the plate 10, the wavy profiles following one another, in particular, at a close distance and being oriented in alignment with one another. In this case, the plate 10 has a peripheral bent edge 17 which delimits the plate laterally. The wavy profile 12 in this case runs into the edge.

The wavy profile 12 may in this case be introduced into the plate 10 by embossing. Embossing may in this case be carried out such that the two sides in the plate 10 have wavy profiles deviating from one another, in particular the wavy profile 12 on one side may constitute the negative of the wavy profile 12 on the other side, as is evident, for example, from the exemplary embodiment according to FIGS. 1*a* and 1*b*. It is also possible for a plate 10 to have the same wavy profile 12 on both sides. In both instances, the wavy profiles on the two sides of a plate 10 may be formed so as to be in alignment with one another or so as to be offset with respect to one another. The wavy profile 12 is characterized in cross section, above all, in that it has a wave back forming a flat region which runs parallel to the plate plane. The flat region in this case preferably has a width of between 0.1 mm and 0.4 mm.

In the region of the corners, the plate has a bore 18 which passes through the plate perpendicularly with respect to its running plane. Two of the bores are in this case introduced in a raised region 19. One of the bores in this case serves for supplying working medium into the region between two plates, while, in particular, the diametrically opposite bore serves for the outflow of working medium. Another pair of bores serves for the inflow and outflow of cooling medium. When plates 10 are stacked one on the other, as illustrated in FIG. 2, the lines assigned either to the working medium or to the cooling medium are in each case alternately connected fluidically to the interspace 20 between two plates 10, since the raised region 19 of corresponding bores 18 bears against the adjacent plates 10. The bores 18 thus form, through a stack 21 of plates, the supply lines and outflow lines for cooling medium and working medium. FIG. 2 shows a perspective illustration of such a stack 21 of plates 10 according to FIGS. 1*a* and 1*b*.

Figure 3:
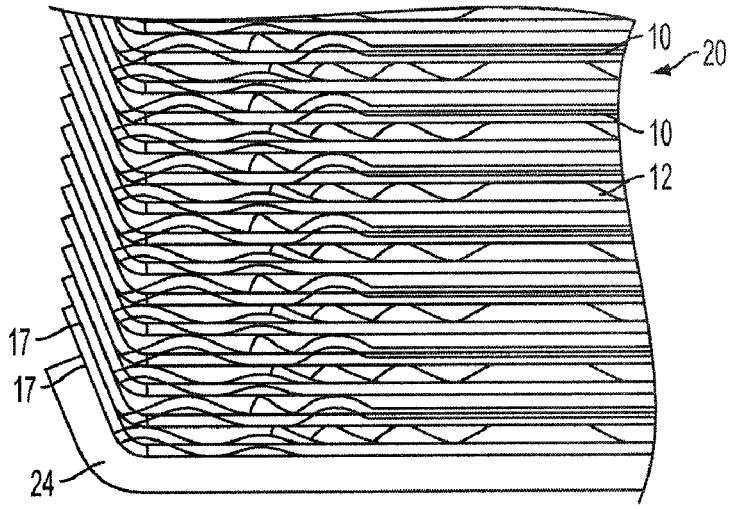
FIG. 3 shows a sectional illustration of multiple plates stacked one on the other in the region of the edge.

FIG. 3 shows a sectional illustration through a stack 21 according to FIG. 2. Plates 10 bear one against the other and are stacked one above the other. The bent edges 17 of adjacent plates bear one against the other and are designed such that the edges of a plurality of plates in each case mutually overlap. In order to achieve a fluidtight connection between the edges 17 of two adjacent plates, these are connected to one another by brazing. Furthermore, two plates adjacent to one another bear one against the other in different regions of their wave profiles 12. In these regions, too, the plates are connected to one another by brazing. To make the soldered connections, the plates may be coated with a solder on one side or on both sides. An interspace 20 is formed in each case between two plates 10 adjacent to one another, either working medium or cooling medium flowing through the interspace.

The stack of plates is in this case designed, in particular, such that working medium and cooling medium flow alternately through the interspaces 20, so that, on the one hand, cooling medium and, on the other hand, working medium flow around each of the plates 10. Heat exchange between the cooling medium and the working medium can thus take place over each of the plates 10.

Since the plates have a wavy profile, the interspace 20 has a different clear width at a multiplicity of points. The repeatedly occurring changes in direction of the fluid in the duct and the vortices formed in the region of the opening wave duct repeatedly break up the boundary layer which is formed. This leads to greatly improved heat transmission, as compared with a smooth duct.

This is conducive to the other exchange between the two media over a plate 10. What is additionally achieved by the configuration of the plates 10 is that no rectilinear flow from the supply line to the outflow line is possible. Depending on the viscosity of the medium, such a configuration of the interspace 20 may also have the result that turbulent flows arise completely or partially and therefore an improved heat exchange between the working medium and cooling medium is achieved. Furthermore, owing to the run of the wavy profile 12 transversely with respect to the extent of the plate 10, the corresponding medium is also guided over the entire width of the plate 10, so that the utilization of the heat exchange surface which a plate 10 offers is improved, with the result that the efficiency of such a heat exchanger is further increased. An essential guide element for the flow routing is also to be seen in that contact points, which act as a flow obstacle and flow deflection points, repeatedly occur between two adjacent plates 10 in the same way as a Dalton grid. Furthermore, these contact points act as a support of the plates one against the other and thus have a stabilizing function for the plates 10, in particular with regard to the intended behavior of the plates 10. In order to obtain a uniform value, illustrated in FIG. 8, for the hydraulic diameter between two plates, the arrangement of the contact points of the profiles of adjacent plates is important. These arise from the wavy profiles of mutually confronting sides of the plates and from the profile runs. A uniform hydraulic diameter ensures a uniform throughflow of the fluid over a wavy profile and over the entire width of the plate interspace. By a selection of the structural configuration of the wavy profile, a hydraulic diameter which is optimized for the intended use is achieved.

Figure 4:
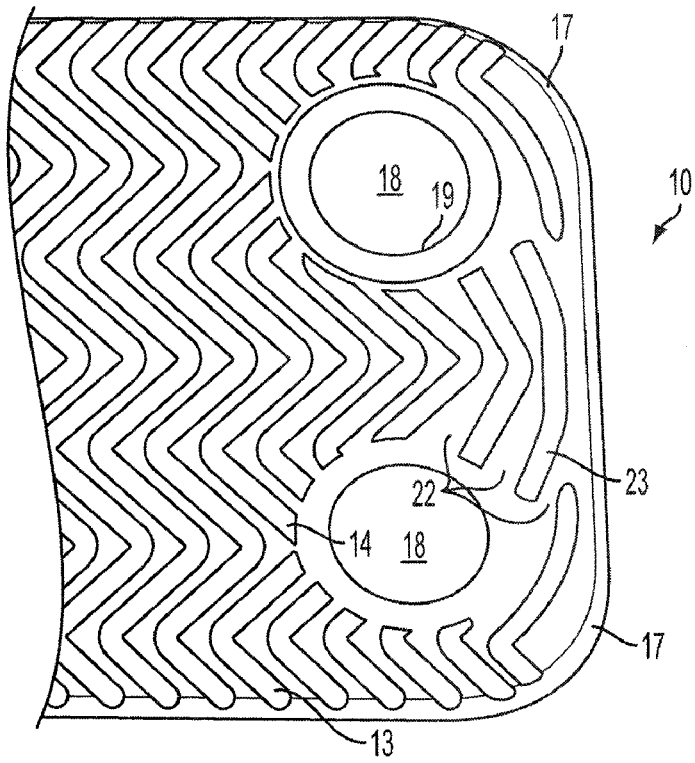
FIG. 4 shows an enlarged illustration of the formation of the distributor ducts in the region of the bores.

FIG. 4 shows an enlarged illustration of a plate 10 with a wavy profile 12 which is formed by the legs 14 which have a leg angle 13 of 450 to one another. The plate 10 is delimited by a bent edge 17, the wavy profile 12 extending into the region of the edge 17.

This fig. shows, in particular, the region between two bores 18, one of which is formed in a dome-shaped raised region 19. In the region between the two bores 18, which, in particular, also extends into the region between the bores 18 and the near edge 17, distributor ducts 22 are formed. The distributor ducts 22 are in this case formed by a wavy profile 23 which differs from the wavy profile 12 in the remaining region of the plate 10 in terms of the leg angles and of the leg lengths. The leg angles are, in particular, in a range below 450. The distributor ducts 22 route, particularly in the region of the bore which is not introduced in a raised region 19, transversely with respect to the main extent of the plate 10, medium which enters the corresponding interspace, and thus ensure a uniform distribution of the fluid stream over the entire width of the plate. The raised region 19 into which the other bore 18 is introduced in this case bears sealingly, in particular, against the bore region of the plate 10 lying above it in a stack and can be connected to this bore region by brazing. A fluidtight closure of the interspace 20 with respect to the plate 10 lying above it is thereby provided, so that no flow of medium can take place between this bore 18 and the interspace and the medium flowing through this bore 18 can enter the then following interspace 20 only downstream of the plate 10 lying above it. For an increase in cross section, the bores 18 may also be designed in the form of a long hole, the long hole axis then extending preferably transversely with respect to the main throughflow direction H.

Figure 4A:
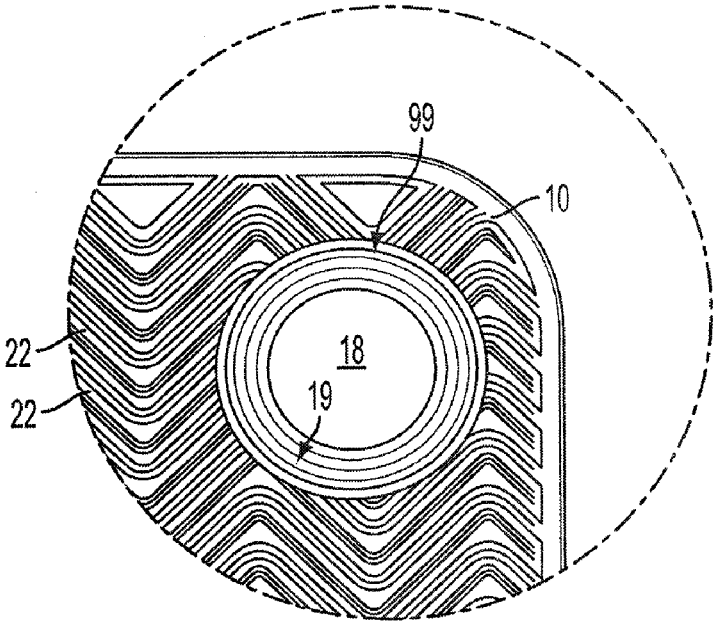

Further, as shown in FIG. 4*a*, a profile-free annular region 99 around a region 19 raised in a dome-shaped manner may form a duct which connects a plurality of wavy profiles 23 and distributor ducts 22 to one another and ensures a good transverse distribution of medium, since it forms a region having low flow resistance. The annular region 19 in this case has an embossing depth which corresponds essentially to the embossing depth of the wavy profile 23.

Figure 5:
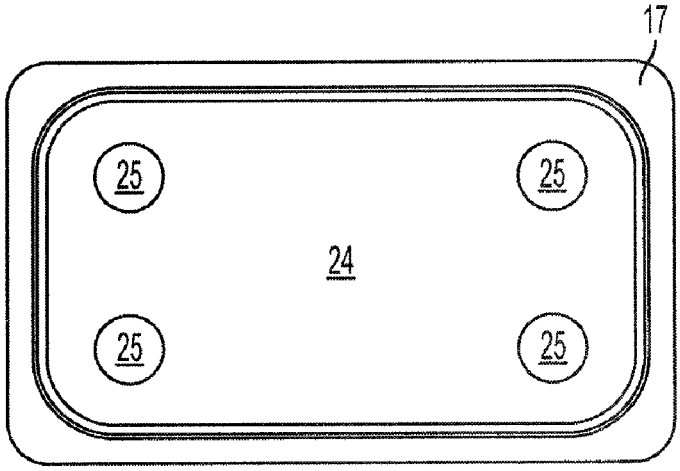
FIG. 5 shows a diagrammatic illustration of a closing plate with connecting flanges.

FIG. 5 shows a top view of the illustration of a closing plate 24 which has four connecting flanges 25 which are arranged in alignment with the bores 18 of the plates 10 of a plate stack 21. Such a closing plate may be arranged on one side or on both sides of the stack 10 and close off the latter outwardly. The closing plate 24 has no wavy profile 12 at least on the outer side. If a connecting plate 24 is arranged on each of the two sides of the plate stack, it is possible for one of the two plates to have four connecting flanges 25 or for one plate to have one, two or three connecting flanges 25 and the opposite plate to have the remaining number of the 4 connecting flanges 25. The connecting flanges 25 are in each case assigned to the connecting bores. The connecting flanges 25 serve for the connection of the external lines for the supply and discharge of working medium and cooling medium. Furthermore, the closing plate 24 reinforces the plate stack 21 and forms the end-face housing wall. In this case, the closing plate 24 may have an edge 17 which is adapted to the edge 17 of the plates 10. In a plate stack 21, such as is illustrated in FIG. 2, the plate edges 17 lying one above the other form the lateral housing wall of the heat exchanger. A plate stack according to FIG. 2, provided with connecting flanges 25 and a closing plate 24, thus forms a heat exchanger. Such a heat exchanger may serve, in particular, as an oil cooler in a vehicle.

Figure 6:
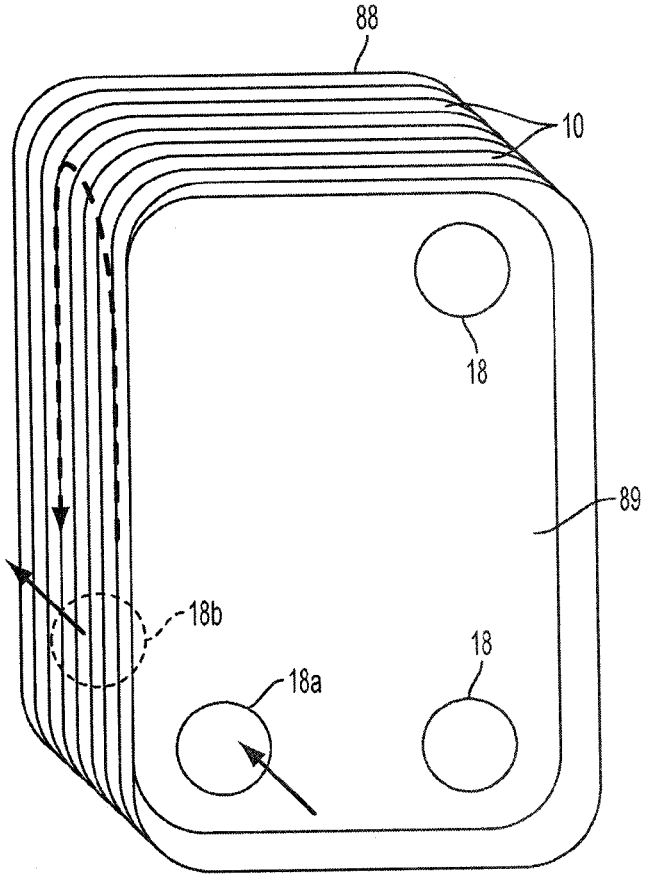
FIG. 6 shows the fluid route through the plates when there is a throughflow of all the plate interspaces in the case of one of the fluids.

FIG. 6 shows a plate stack 21 comprising a baseplate 88, of plates 10 and of a cover plate 89 which has three bores 18, 18*a*. The bores 18 serve for routing a first medium which is led through between the plates in such a way that it flows through the plate interspaces 20 parallel to one another. A second medium enters the plate stack through the bore 18*a* and re-emerges from the plate stack through the bore 18*b* in the baseplate.

By means of at least one partition which is arranged between the bores 18*a* and 18*b* and cannot be seen from outside, the flow ducts for the second medium are divided into at least two flow paths through which the latter flows in succession and which each comprises one or more flow ducts. By contrast, the first medium flows through the flow ducts of the latter in parallel. In a modified exemplary embodiment, by contrast, the flow ducts for the first medium are likewise divided into at least two flow paths through which the first medium flows in succession.

Figure 7A:
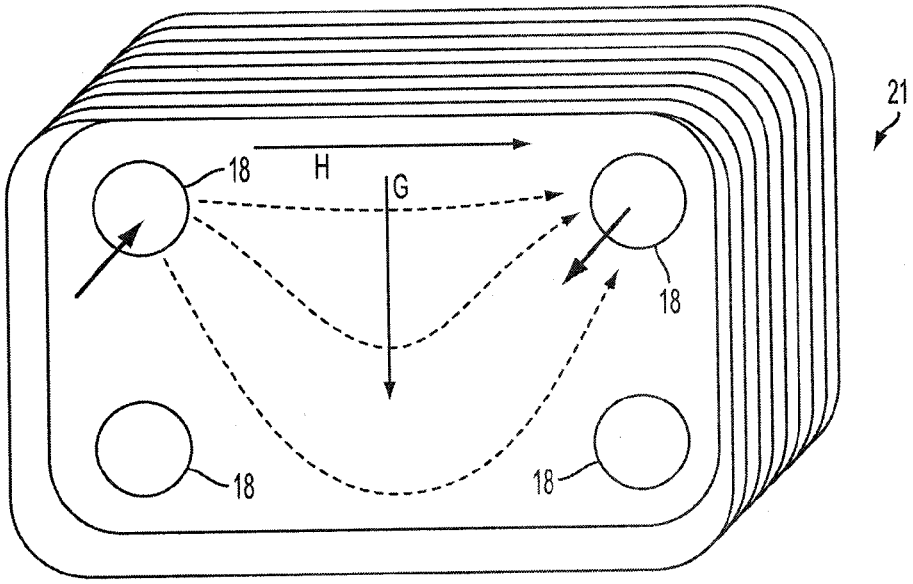
FIG. 7*a*-7*d* show the effects of gravitation on liquid distribution.
Figure 7B:
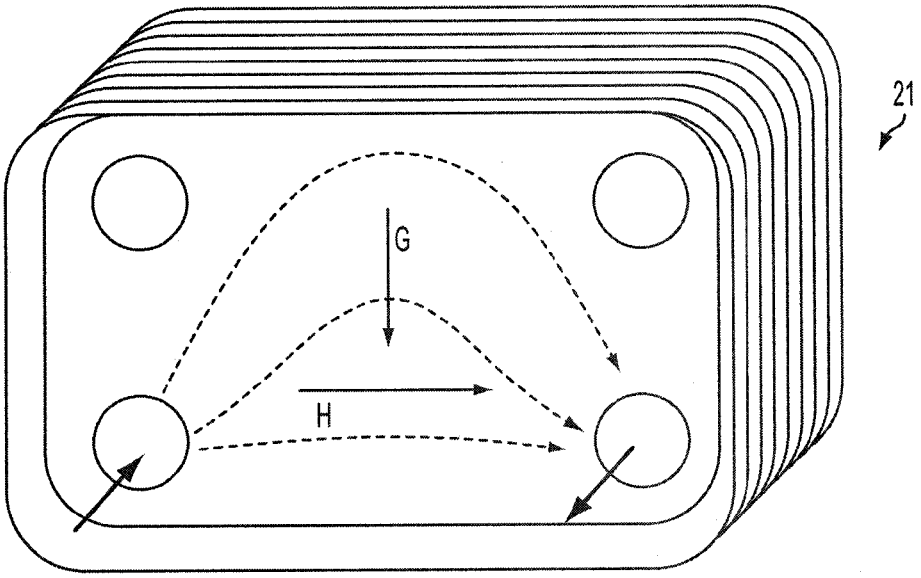
Figure 7C:
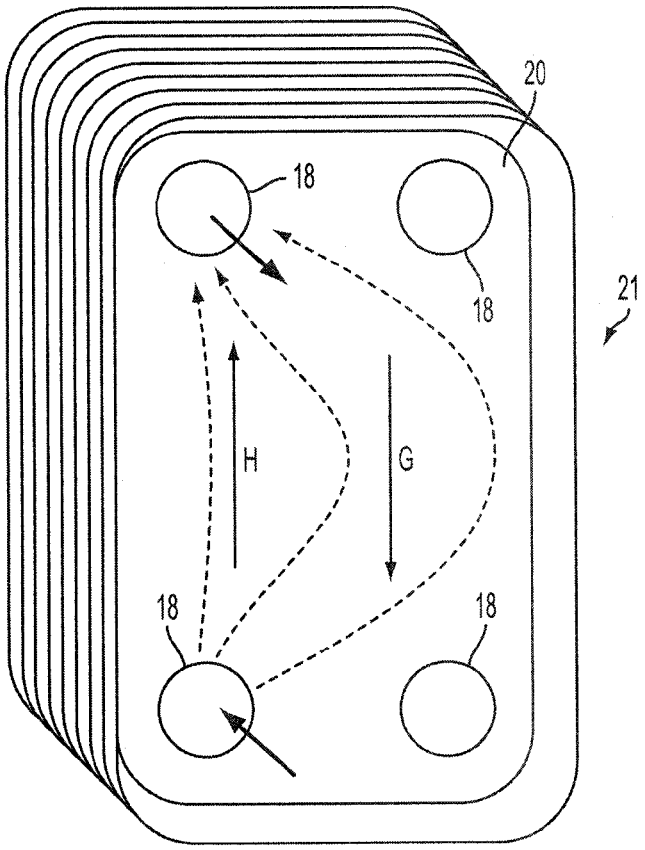
Figure 7D:
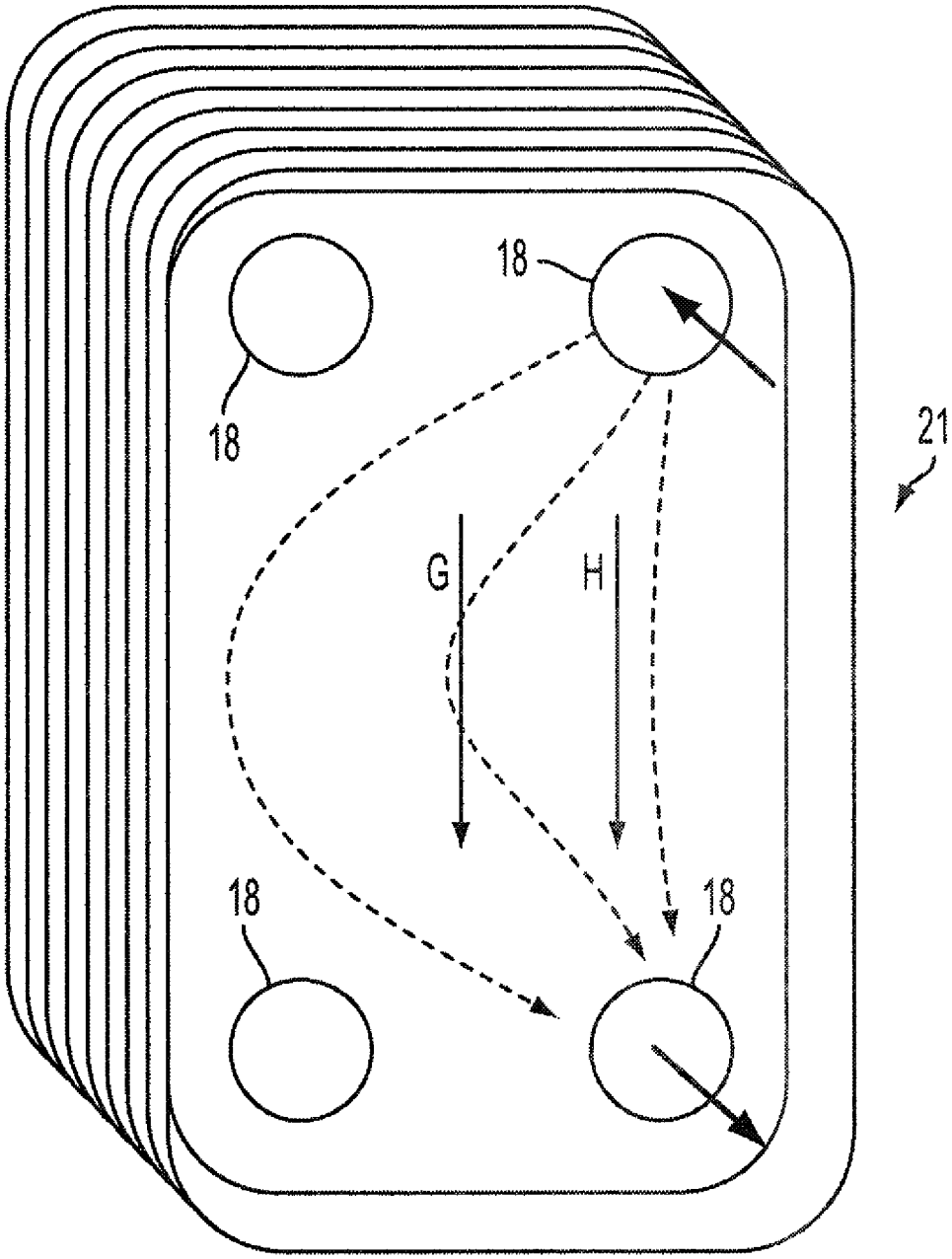

FIG. 7*a* to 7*d* show different orientations of the main throughflow direction H of the plate interspace 20 in relation to the gravitation direction G in the installation position of the heat exchanger, and also the favorable influence on the distribution of the medium in the plate interspace, particularly in the use as a condenser. FIGS. 7*a* and 7*c* show the application as an evaporator. It is evident from FIG. 7*a* and 7*c* that the main throughflow direction H should be transverse or anti-parallel to the gravitation direction G, depending on whether the longer side L or narrower side S of the plates is oriented in the gravitation direction G, should a liquid medium be concerned. As a result of gravitation, a transverse distribution of the medium with respect to the main throughflow direction is assisted. By contrast, FIG. 7*b* and 7*d* show that a gaseous medium is best distributed between the plates 10 when the gravitation direction G counteracts the distribution of the medium between the plates.

Figure 8:
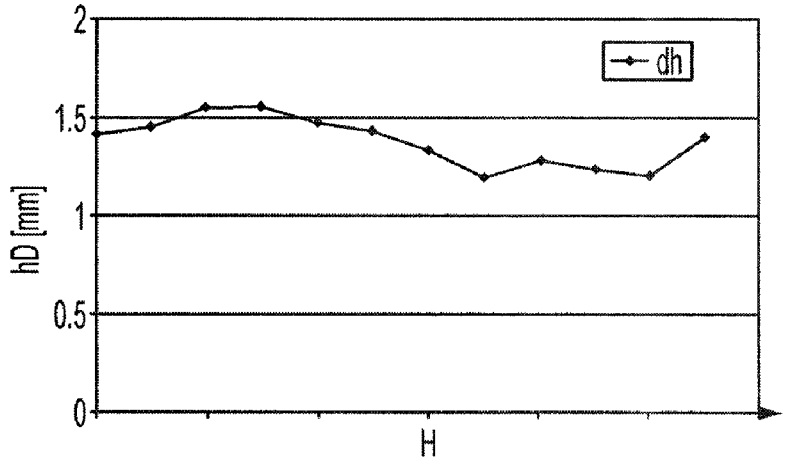
FIG. 8 shows the hydraulic diameter over a period of the wavy profile in the main flow direction of the medium in the interspace of two plates.
Figure 8A:
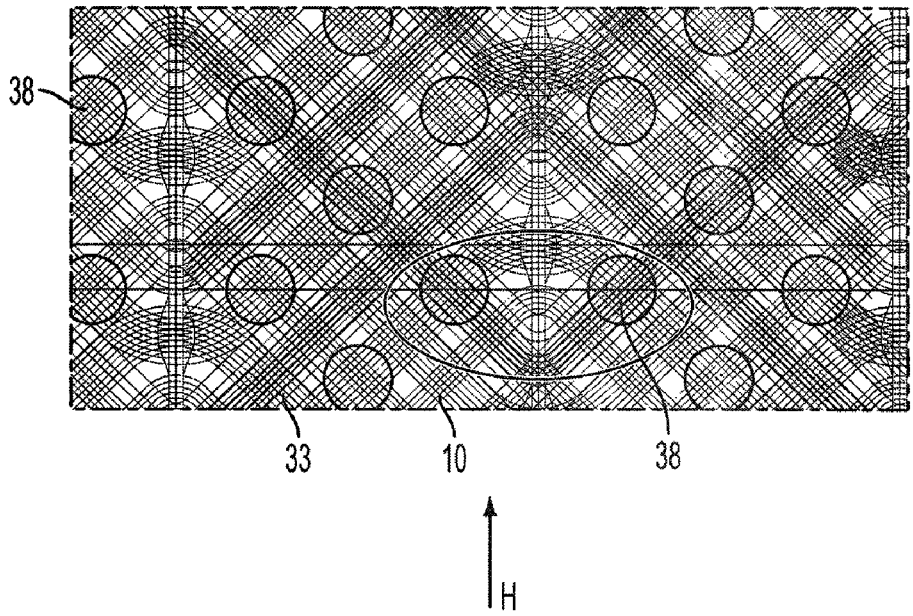
FIG. 8*a* shows a top view of a plate of a heat exchanger.

FIG. 8 shows the hydraulic diameter over an entire wavy profile in the main throughflow direction H, FIG. 8*a* illustrating the formation of the wavy profile 23 together with the plates 10 adjacent to contact points depicted as circles 98. It can be seen that, over the entire period of the pattern resulting from the wavy profiles 23 of the adjacent plates, the wavy profile moves in a bandwidth of between 1.2 and 1.6 and amounts on average to approximately 1.4. The formation of the wavy profiles is preferably selected such that as constant a hydraulic diameter as possible is obtained in the main throughflow direction.

The contact points between two plates of the heat exchanger which are adjacent to one another are illustrated in FIG. 8*a* as circles in a top view of one of the plates. It can be seen clearly that the contact points are distributed uniformly over the plate surface. A preferred surface density of the contact points for sufficient strength is 4 to 7 per $cm^2$, particularly preferably 5 to 6 per $cm^2$. This becomes clear from FIG. 8*b*, 8*c*.

Figure 8B:
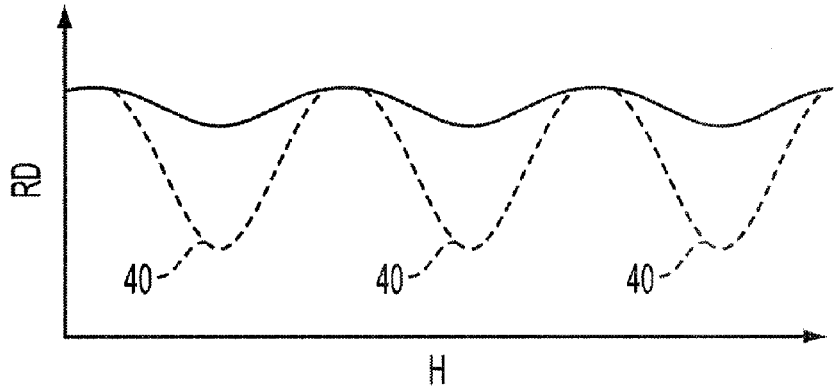
FIG. 8*b* shows the hydraulic diameter in the main flow direction of the medium in the interspace of two plates.

FIG. 8*b* shows the hydraulic diameter hD of a flow duct between two plates over a plurality of profile periods, specifically, once again, in the main flow direction H of the medium. A high surface density of the contact points gives cause to expect a run which is illustrated by the broken curve in FIG. 8*b*, since a large number of contact points, arranged next to one another, as seen in the main flow direction H, restrict the flow duct cross section. This is made clear by the collapses 40 in the hydraulic diameter. Owing to the configuration according to the invention, in particular the uniform distribution, of the contact points, these collapses are eliminated or reduced, so that the run illustrated by an unbroken line is obtained for the hydraulic diameter. The fewer of these collapses a flow duct possesses, the fewer contractions for the flowing medium the duct possesses, that is to say, with the surface density of the contact points being the same, the pressure loss can be reduced.

A uniform distribution is achieved, in particular, in that a region of curvature between two, in particular, rectilinear legs of a wavy profile of a plate does not come to lie exactly above a region of curvature of an adjacent plate. On the contrary, under certain circumstances, it is advantageous if the regions of curvature of adjacent plates are offset with respect to one another, as seen in the main flow direction, in such a way that each region of curvature is flanked transversely to the main flow direction by two contact points for the two plates which advantageously are at an equal or similar distance from one another to that of other contact points and which thus release between them a flow passage which allows an appreciable throughflow, and therefore do not contribute to an undesirable extent to a pressure loss of the flow duct formed between the plates. On the other hand, the selected distance between two contact points must also not be too great, since otherwise, under certain circumstances, local weak points in the strength of the heat exchanger could be formed.

Figure 8C:
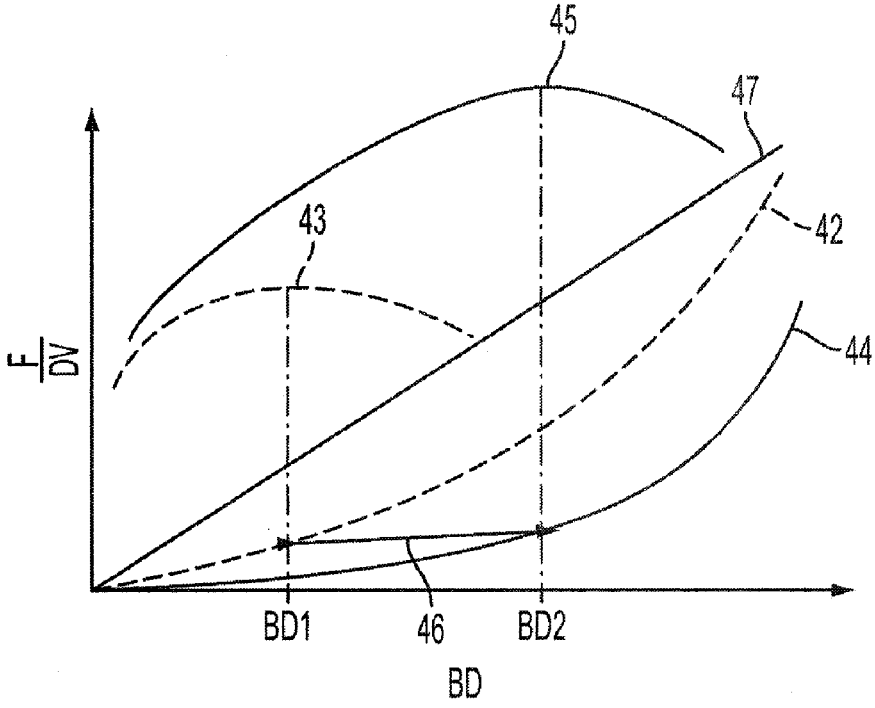
FIG. 8*c* shows a plot of the strength and pressure loss of a heat exchanger against the density of the contact points between two plates.

FIG. 8*c* illustrates a plot of the strength F and of the pressure loss DV of a heat exchanger against the density BD of the contact points between two plates. The strength of the heat exchanger rises linearly with the contact point density BD and is reproduced in FIG. 8*c* as a straight line 41. In contrast to this, in this plot (42), the pressure loss DV has a progression, thus resulting, for the ratio F/DV of strength F to pressure loss DV, in a maximum 43 in the case of a contact point density BD1. If, then, according to the invention, the pressure loss is lowered (44), said maximum is raised (45) and, if appropriate, shifted to a higher contact point density BD2. It was shown experimentally that a contact point density of 4 to 7 per $cm^2$, preferably from 5 to 6 per $cm^2$, leads to good strength, along with an acceptable pressure loss.

In other words, as illustrated in FIG. 8*c* by the arrow 46, with the pressure loss DV remaining the same, there can be a transition to a higher contact point density BD which leads to an increased strength F of the heat exchanger.

Figure 9:
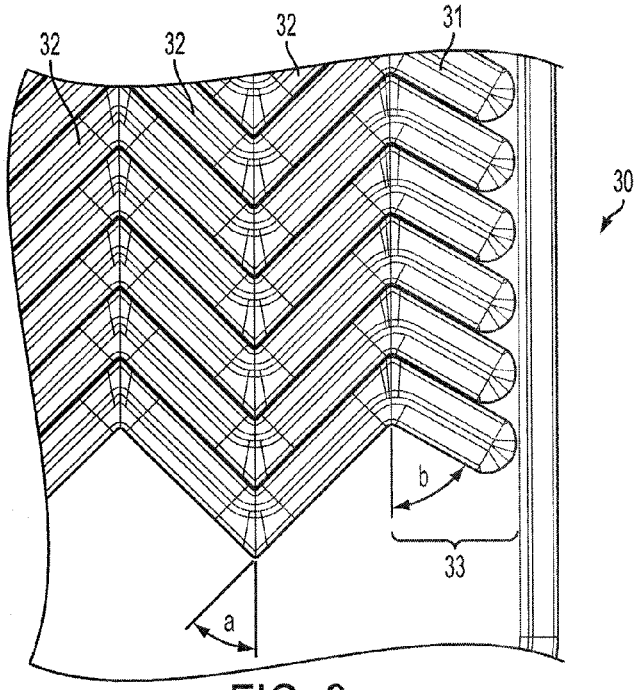
FIG. 9 shows a detail of a heat exchanger plate.

FIG. 9 illustrates a detail of a plate 30 of a heat exchanger. The connection points between two adjacent plates are given by the intersection points of the respective wavy profiles of the two plates. In order to ensure that a distance between the plate edge and the near-edge intersection points is not too great, it is advantageous, under certain circumstances, to modify the geometry of the outermost legs, as compared with the geometry of the inner legs of the wavy profiles. For this reason, where the plate in FIG. 9 is concerned, the leg angle 2*b* of the outer legs 31 differs from the leg angle 2*a* of the inner legs 32. As can be seen in FIG. 9, the leg half angle b in an edge region of the plate 30 amounts, for example, to 60°, with a leg half angle of 45° in a middle region of the plate. This achieves, in the edge regions 33 of the plates, a more uniform distribution of the connection points and consequently an increased compressive strength of the heat exchanger.

Figure 10:
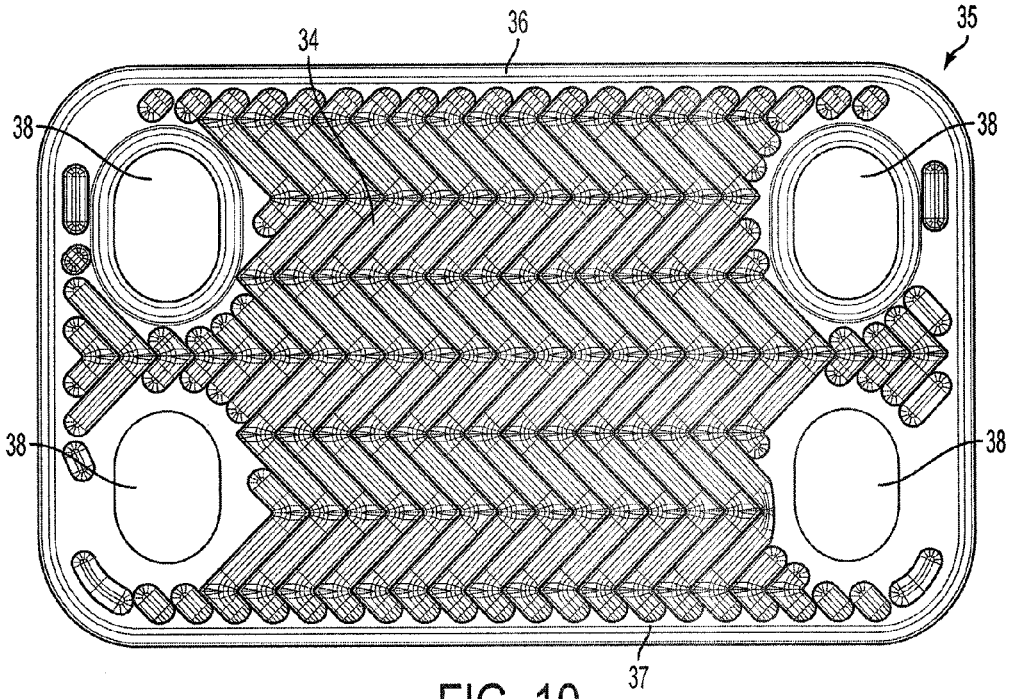
FIG. 10 shows a plate of a heat exchanger.

FIG. 10 shows a plate 35 of a heat exchanger, in which a wavy profile 34 extends as far as the bent plate edge 36, a remaining duct 37, which, under certain circumstances, allows an undesirable bypass flow, having a very small cross section, so that the bypass flow can be reduced. Particularly in the case of a soldered heat exchanger, that is to say when the plate 35 is solder-plated, solder meniscuses which reduce or particularly advantageously close the edge duct 37 are formed between the outermost legs 38 of the wavy profile 34 and the bent plate edge 36.

In order to bring about a reduction in the pressure loss caused by the heat exchanger, the perforations 38 of the plate and consequently the cross sections of the collecting ducts thereby formed are widened ovally.

Figure 11A:
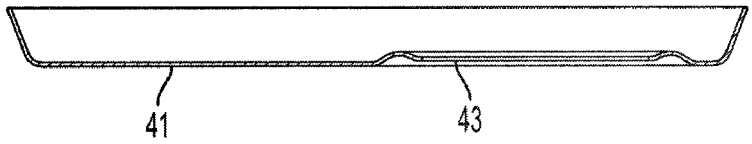
FIG. 11*a, b* show in each case a cross section of a heat exchanger in the form of a detail.
Figure 11B:
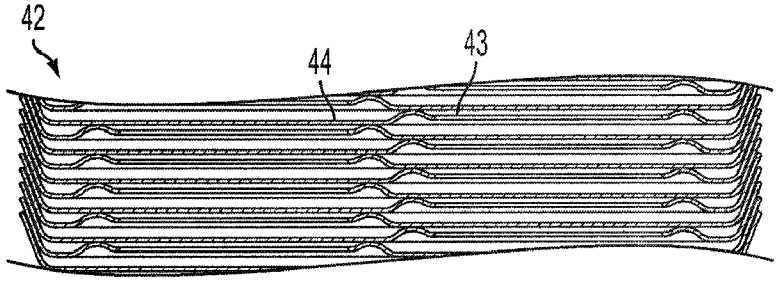

FIG. 11*a* shows a cross section of a plate 41 of a heat exchanger 42 which is constructed from a plurality of plates 41, as depicted in FIG. 11*b*. The plates 41 have in each case, as inflow lines and outflow lines, a pair of bores 43 perpendicularly to the plate plane, the bores 43 being raised with respect to the basic plane of the respective plate 41 in such a way as to form a fluidic connection from one of the two bores alternately only to every second plate interspace 44. As can be seen in FIG. 11*b*, in each case a raised bore 43 bears against a nonraised region of an adjacent plate 41, so that the height of the raised region is, for example, as great as the height of a wavy profile of the plate 41.

Figure 12A:
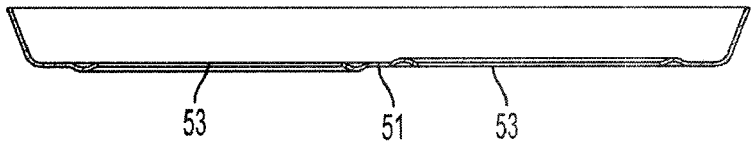
FIG. 12*a, b* show in each case a cross section of a heat exchanger in the form of a detail.
Figure 12B:
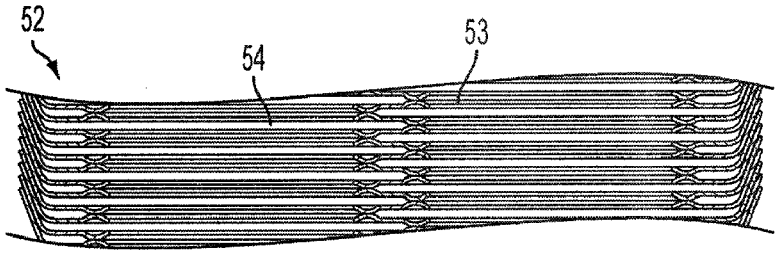

FIG. 12*a* shows a cross section of a plate 51 of a heat exchanger 52 which is constructed from a plurality of plates 51, as depicted in FIG. 12*b*. The plates 51 have in each case, as inflow lines and outflow lines, a pair of bores 53 perpendicularly to the plate plane, the bores 53 being raised with respect to the basic plane of the respective plate 51 in such a way as to form a fluidic connection from one of the two bores alternately only to every second plate interspace 54. As can be seen in FIG. 12*b*, in each case a raised bore 53 bears against a raised bore 53 of an adjacent plate 51, so that the height of the raised region is, for example, only half as great as the height of a wavy profile of the plate 41. By virtue of this type of construction, under certain circumstances, a thinning of material during the production of the raised regions is reduced, so that a tensile strength, that is to say internal compressive strength, of the heat exchanger 52 is favorably influenced at least in these regions.

The invention claimed is:

1. A heat exchanger for motor vehicles, the heat exchanger being formed from interconnected plates, there being formed between the plates cavities which are closed off outwardly and through which a first and a second medium flow alternately in each case via at least one inflow line and outflow line, the plates being profiled in such a way that, between the respective profiles of the plates, contact points occur, in the region of which the plates are fastened to one another, wherein the profiles of the plates and their contact points are designed in such a way that the flow, formed between the plates, of the first and the second medium from the corresponding inflow line to the corresponding outflow line does not run rectilinearly, wherein the plates have a recurring wavy profile which extends essentially transversely with respect to the main throughflow direction (H), wherein the plates have a bent edge, the edges of adjacent plates bearing one against the other and being connected to one another by brazing; and wherein between the end of the wavy profile and the edge, a profile-free bending portion is formed, the width of which is smaller than 2 mm and is determined in such a way that, during the brazing of the plates, a throughflow of medium in the bending portion is reduced or essentially prevented.

2. The heat exchanger as claimed in claim 1 wherein the recurring wavy profile has a flat region on the outside of a wave back.

3. The heat exchanger as claimed in claim 2 wherein the flat region is between 0.1 mm and 0.4 mm in a cross section of the legs.

4. The heat exchanger as claimed in claim 1, wherein an angle formed by legs of one of the recurring wavy profiles is between 45° and 135°.

5. The heat exchanger as claimed in claim 1 wherein a depth of the recurring wavy profile is, in the case of liquid media between 0.5 mm and 1 mm and in the case of gaseous media between 0.6 mm and 2 mm.

6. The heat exchanger as claimed in claim 1, wherein the recurring wavy profile comprises embossings in the plate, the plates comprising aluminum and being coated on at least one side with soldering aid material.

7. The heat exchanger as claimed in claim 1, wherein the plates have as inflow lines and outflow lines in each case a pair of bores perpendicularly with respect to the plate plane, the bores being raised with respect to the basic plane in such a way that there is a fluidic connection from one of the two bores alternately only to every second plate interspace.

8. The heat exchanger as claimed in claim 7, wherein the raised region of at least some of the bores is surrounded by a region leading around annularly and free of the recurring wavy profile.

9. The heat exchanger as claimed in claim 7, wherein the bores assigned to the inflow lines are oval, elliptical or rectangular.

10. The heat exchanger as claimed in claim 1, wherein two plates different from one another in terms of the recurring wavy profiles are used alternately.

11. The heat exchanger as claimed in claim 1, wherein the recurring wavy profiles of one side of the plates differ from the recurring wavy profiles of the other side of the plates.

12. The heat exchanger as claimed in claim 1, wherein the recurring wavy profiles of adjacent plates are identical to one another.

13. The heat exchanger as claimed in claim 1, the plates corresponding to one another and being arranged so as to be rotated alternately through 180° with respect to one another.

14. The heat exchanger as claimed in claim 1, wherein the bent edges of a plurality of the plates mutually overlap.

15. The heat exchanger as claimed in claim 1, wherein the recurring wavy profile extends into the edge.

16. The heat exchanger as claimed in claim 7, wherein at least one end face of the heat exchanger is assigned a closing plate which is profileless at least on the outside and which has connection points for a first and second medium, said connection points issuing into connecting lines and being arranged in alignment with the bores.

17. The heat exchanger as claimed in claim 1, wherein the hydraulic diameter (hD) has an average value of either between 1 mm and 2 mm or around 3 mm.

18. The heat exchanger as claimed in claim 1, wherein the contact points between two plates adjacent to one another are distributed uniformly over the plate surface.

19. The heat exchanger as claimed in claim 1, wherein the contact points between two plates adjacent to one another have a surface density of 4 to 7 per $cm^2$.

20. The heat exchanger as claimed in claim 1, wherein a phase transition of a medium takes place in plate interspaces.

21. The heat exchanger as claimed in claim 1, wherein the installation position of the heat exchanger is determined such that the transverse distribution of the medium in the plate interspaces is assisted by gravitation.

22. A method for the production of a heat exchanger as claimed in claim 1 wherein the method comprises the steps of embossing the plates, of stacking the plates one on the other and of fastening them to one another, by brazing.

23. The method as claimed in claim 22, wherein the stacking of the plates one on the other takes place such that two adjacent plates are in each case rotated through 180 degrees with respect to one another.

24. The method as claimed in claim 22, wherein brazing takes place in such a way that the plates are connected sealingly to one another at their edge, a connection of adjacent plates to one another at contact points of the recurring wavy profile taking place at the same time.

25. The heat exchanger as claimed in claim 1, wherein said recurring wavy profiles include at least three regions of curvature and at least four legs.

26. The heat exchanger as claimed in claim 1, wherein the plates have first and second opposite side edges and first and second opposite end edges and wherein said recurring wavy profiles extend from said first side edge to said second side edge and from said first end edge to said second end edge.

27. The heat exchanger as claimed in claim 26, including at least two openings interrupting said recurring wavy profiles.

* * * * *